United States Patent [19]

Crissman et al.

[11] 4,009,089

[45] Feb. 22, 1977

[54] FILTERING PROCESS

[75] Inventors: James H. Crissman, Kiskiminetas Township; G. Ray Fritsche, Bradford Woods, both of Pa.

[73] Assignee: Gulf Research & Development Company, Pittsburgh, Pa.

[22] Filed: Sept. 15, 1975

[21] Appl. No.: 613,257

[52] U.S. Cl. ..... 204/188; 204/302

[51] Int. Cl.[2] ..... B03C 5/00

[58] Field of Search ..... 204/186–191

[56] References Cited

UNITED STATES PATENTS

| | | | |
|---|---|---|---|
| 2,116,509 | 5/1938 | Cottrell | 204/188 |
| 2,573,967 | 11/1951 | Hamlin | 204/188 |
| 3,799,856 | 3/1974 | Franse | 204/188 |
| 3,799,857 | 3/1974 | Franse | 204/188 |
| 3,928,158 | 12/1975 | Fritsche | 204/302 |

*Primary Examiner*—T. M. Tufariello

[57] ABSTRACT

A process for separating finely divided, electrically conductive materials from hot liquid hydrocarbons. The process is particularly valuable in the treatment of a liquid hydrocarbon feed stock for a fixed bed catalytic process such as hydrodesulfurization of gas oils or heavier petroleum fractions, or for hydrocracking. The feed stock is made to flow longitudinally through a bed of spherical glass particles between electrodes. A voltage gradient of 5 to 25 kv per inch is applied to the electrodes. Periodically the filter is cleaned by backflushing with filtered product. The backflush liquid and entrained solids are delivered into a thickener consisting of a hollow vessel having a pair of vertical electrodes between which the backflush liquid is passed downwardly. Suspended particles aggregate and rapidly settle from the liquid.

11 Claims, 1 Drawing Figure

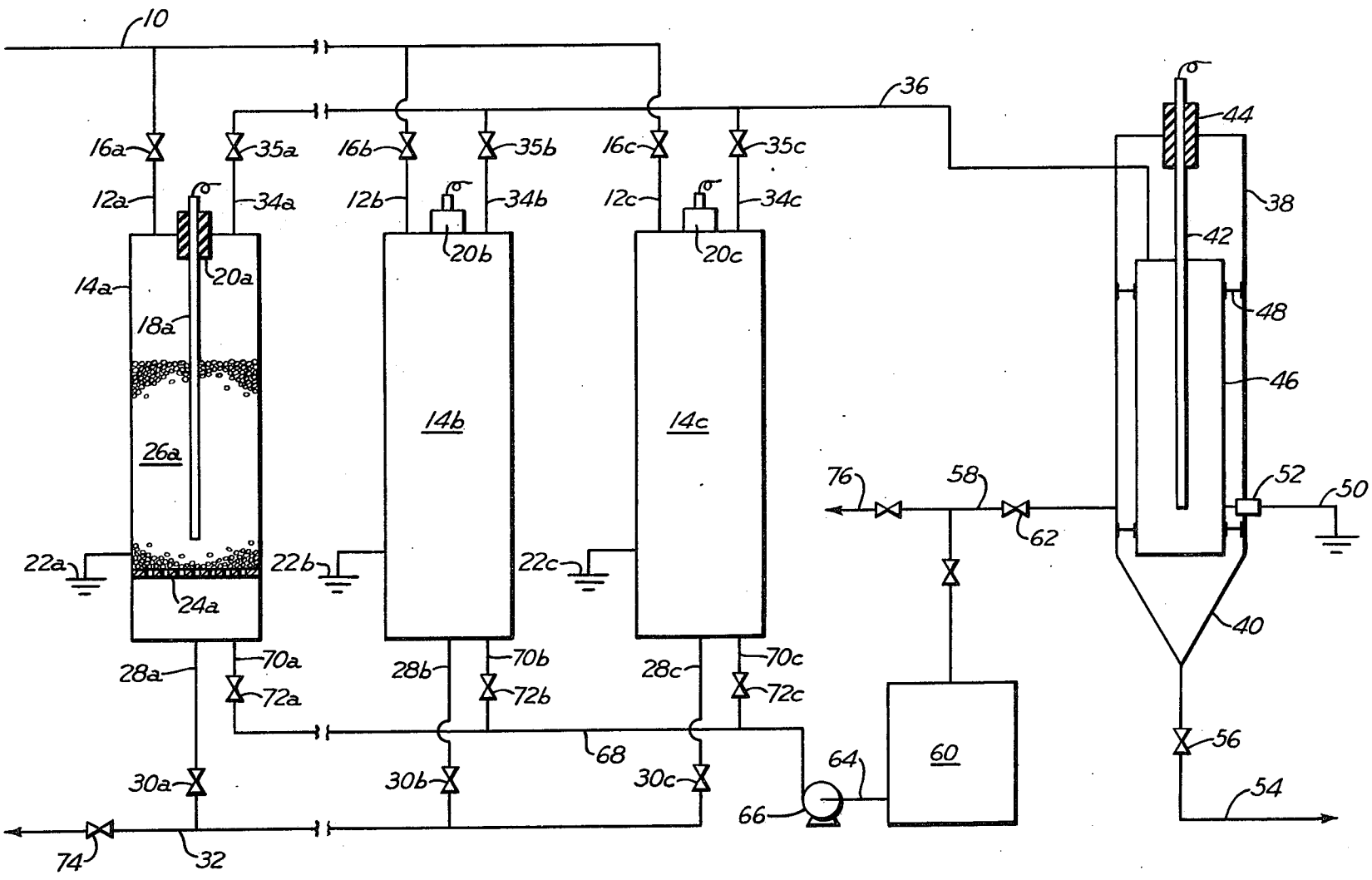
10
12a
14a
16a
18a
20a
22a
24a
26a
28a
30a
32
34a
35a
70a
72a
74
12b
14b
16b
20b
22b
28b
30b
34b
35b
70b
72b
12c
14c
16c
20c
22c
28c
30c
34c
35c
70c
72c
36
38
40
42
44
46
48
50
52
54
56
58
60
62
64
66
68
76

FILTERING PROCESS

BACKGROUND OF THE INVENTION

This invention relates to the refining of petroleum and more particularly to the removal of finely divided solid particles from liquid hydrocarbon fractions.

In the refining of petroleum, an initial step is to distill the petroleum to separate the oil into a number of fractions by virtue of the difference in their boiling points. Some of the fractions from the distillations are further processed by passing them through fixed beds of catalysts under conditions of temperature and pressure, and frequently in the presence of hydrogen, to convert the petroleum fractions to products of higher quality. For example, virgin naphthas separated from crude oil by distillation may be passed through a pretreater containing a fixed bed of catalyst to remove sulfur and nitrogen compounds and then through a reformer. Kerosene and residual oil from the distillation may be subjected to hydrodesulfurization by passing through a fixed bed of catalyst to produce jet fuels or fuel oils of higher quality. Gas oil from the distillation may be passed through a catalytic cracking unit in which part of the gas oil is converted to gasoline and more volatile hydrocarbon fractions and a light gas oil. The catalytically cracked light gas oil may then be hydrocracked by passing it through a fixed bed of hydrocracking catalyst at elevated temperatures and pressures in the presence of hydrogen.

Even though the concentration of solid particles in the liquid hydrocarbon fractions is low, during the long runs through some fixed beds of catalyst the solids may be deposited on the catalyst and can plug beds and necessitate shutting down the process for replacement of at least a part of the catalyst before the catalyst is spent. The loss of production and the direct labor and catalyst replacement costs make the more frequent catalyst replacement very costly. The solid particles may in some instances, and particularly in reduced crudes, be solid particles that were in the crude oil charged to the distillation unit; however, a large part of the solid particles in distillate products from the atmospheric distillation are electrically conductive materials such as iron oxide or iron sulfide particles picked up from the processing vessels.

The size of the suspended solid particles is often extremely small. In some hydrocarbon fractions, for example the charge stock to a hydrocracker, 98 percent of the particles have a diameter less than 5 microns and a major part of the particles have a diameter less than one micron. Such particles do not settle from the hydrocarbon liquids. Filtration of the liquid by passing liquid through a permeable medium is not effective. If the openings in the filter medium are small enough to trap the solid particles, the filter medium quickly becomes plugged. Moreover, most of the liquid hydrocarbon streams in a refinery are hot, and the conventional filter media, such as paper or urethane foam, are not capable of withstanding the high temperature.

DESCRIPTION OF THE PRIOR ART

In U.S. Pat. No. 3,928,158 of Fritsche et al., an electrofilter capable of separating a large part of the particles having a submicron size from hot hydrocarbon liquid streams is described and claimed. The electrofilter consists of a vessel having an electrode extending longitudinally through it spaced from the wall of the vessel. The wall of the vessel is ordinarily grounded and serves as an electrode. The space between the electrode and the wall contains glass spheres. A high voltage of the order of 10 kv per inch of distance between the electrode and the vessel wall is applied to the filter and liquid caused to flow through the permeable bed formed by the glass spheres. The solid particles, even electrically conductive particles such as iron sulfide, are deposited on the spheres.

The spherical particles in the filter are essential to the separation of the very small solid particles in the hydrocarbon stream. An electric precipitator in which the space between the electrodes is open is not effective in separating the solids. It is important that the spherical particles have a smooth surface that is substantially devoid of pores or indentations to allow substantially complete removal of deposited solids by backflushing to thereby return the spherical particles to a condition in which they are effective in precipitating solids. Particles of river gravel are effective in removing solid contaminants from liquid hydrocarbons during the first cycle that the river gravel is used, but the river gravel can not be cleaned adequately by ordinary backflushing to allow its use in subsequent cycles.

While the electrofilter is effective in removing a large part of the solid particles and thereby greatly reducing plugging of the catalyst bed to which the filtered liquid is delivered, the amount of solids that can be separated in the filter before it is reconditioned is small. It is necessary, therefore, to clean the filter at frequent intervals. Cleaning is accomplished by passing a liquid upwardly through the filter at a rate adequate to expand the bed and cause movement of the spherical particles while the electrical power supply to the filter is cut off. The solids deposited on the glass spheres are removed from the filter with the backflush liquid. Apparently, the precipitation of the solid particles in the electrofilter causes some agglomeration of those particles because the solids will settle, although very slowly, from the backflush liquid. The slow settling rates make large settling tanks necessary if the precipitated solids are separated from the backflush liquid by settling. Then there is still a problem of disposing of the settled sludge. Backflushing of an electrofilter is described in U.S. Pat. No. 3,799,857 of A. D. Fran se. It is suggested in that patent that the solids that settle from the backflush liquid be passed through a recovery system for producing dry solids capable of being landfilled In U.S. Pat. No. 3,799,855 of Franse, a similar backflushing procedure is described and it is there suggested that the separated solids can be dried to form a waste solid which could be buried in a landfill.

SUMMARY OF THE INVENTION

This invention resides in a process for separating finely divided solid particles from hot hydrocarbon fractions. In this invention, solids are separated from the hydrocarbon fractions in an electrofilter having a filter bed of glass spheres and the solids removed from the filter by backflushing with the filtered product. The backflushing liquid discharged from the filter is passed through unobstructed space between vertical electrodes in a thickener whereby the solids removed from the filter are further aggregated and settle rapidly from the backflushing liquid.

BRIEF DESCRIPTION OF THE DRAWING

The single FIGURE of the drawing is a diagrammatic flow sheet of a preferred embodiment of this invention.

DESCRIPTION OF PREFERRED EMBODIMENT

Referring to the drawing, a nonconductive liquid, for example hydrocarbon feed stock such as a gas oil suitable as a feed stock for a hydrocracker, normally having suspended therein about 1–10 milligrams of solid particles smaller than 5 microns in nominal diameter per gallon is delivered through a supply header 10 into inlet lines 12*a*, 12*b* and 12*c*. Ordinarily, the feed stock will be at an elevated temperature up to about 300° F. The lower end of the inlet lines is connected into the upper end of electrofilters 14*a*, 14*b* and 14*c*, respectively. In referring to the parts of each of the electrofilters, the same letter added to the reference numeral for the filter is added to the reference numeral for the part of the filter. Ordinarily, the electrofilters 14 have a diameter of 8 to 10 inches. To provide adequate capacity for treatment of the feed stock to a processing unit such as a hydrocracker, a plurality of the electrofilters 14 are connected in parallel. Three of such electrofilters are shown in the drawing merely for the purpose of illustrating the parallel arrangement; however, the supply line 10 and other lines are broken to show that additional filters can be connected in parallel. Each of the inlet lines is provided with a valve 16 for control of flow of hydrocarbon feed into the electrofilters.

Electrofilters suitable for removal of the finely divided solid particles, which may be electrically conductive, are disclosed and claimed in U.S. Pat. No. 3,928,158. The filter consists essentially of an elongated cylindrical casing, which may be constructed of steel and have an internal diameter of 8 inches and a length of 5 feet, having an electrode 18 extending longitudinally down into the casing. The electrodes are insulated from the casing of the filter by a suitable bushing 20 and connected at their upper end to a power source, not shown. The shells of the casings of the electrofilters 14 are grounded, as indicated at 22, and serve as an electrode of the filters. The power source is adapted to apply a voltage gradient of the order of 5 to 20 kv per inch between the electrodes 18 and the shells of the casings. The voltage gradient is preferably DC but may be AC.

Supported on a grid 24 positioned above the bottom of each of the filters 14 is a bed 26 of substantially spherical ceramic particles of high resistivity, preferably a resistivity higher than that of the liquid hydrocarbons. It is imperative that the particles have a smooth outer surface free of indentations or pores to permit substantially complete removal of deposited solids whereby simple backflushing restores the filter bed 26 to substantially its original condition. Glass is a preferred material for the spheres that make up the filter bed 26; however, spheres of other ceramic materials have been found to be useful if they have the requisite smooth outer surface. The ceramic spheres preferably have a particle size in the range of one-thirty second to one-fourth inch in diameter. The level of the upper surface of bed 26 should be well below the upper end of the filter 14 to permit expansion of the filter bed during the backflushing operation, as hereinafter described. Extending from the lower end of the filters 14 are outlet lines 28*a*, 28*b*, and 28*c* having valves 30*a*, 30*b*, and 30*c* therein. Each of the outlet lines 28 is connected into a filtered product line 32 for delivery of the filtered product from the electrofilters.

Extending upwardly from the filters 14*a*, 14*b* and 14*c* are backflush outlet lines 34*a*, 34*b* and 34*c*. Each of the backflush outlet lines is connected into a backflush liquid header 36 which is connected into an electrothickener 38.

Electrothickener 38 is shown in the form of a vertical cylinder having a downwardly tapering lower end 40. Extending downwardly through the electrothickener along the center line thereof is an electrode 42. Electrode 42 may, for example, be a steel rod. It is preferred that the electrode be in the form of a rod having small ridges extending outwardly from its outer surface, and still more preferably a rod which has been threaded for substantially its full length to provide a sharp helical ridge extending from the lower end of the rod to the upper end. The rod is shown terminating a short distance above the upper end of the downwardly tapering conical section of the thickener. Electrode 42 is insulated from the casing of the thickener 38 by a suitable bushing 44. The upper end of the rod is connected to a power source, not shown, adapted to apply a potential gradient of the order of 10 to 30 kv per inch between the electrode 42 and a surrounding electrode.

In the embodiment illustrated in the drawings, the surrounding electrode is in the form of a sleeve 46 suitably supported from the wall of the thickener 38 by insulated brackets 48 positioned at intervals around the sleeve. Sleeve 46 may be in the form of a metal sheet or wire grid. Sleeve 46 terminates at the upper end of the conical section 40 of the thickener. A conductor 50 insulated from the thickener 38 by a suitable insulating bushing 52 grounds the sleeve. The space between the electrode 42 and sleeve 46 is unobstructed in that such space is empty except for the backflush liquid. Line 36 preferably extends into sleeve 46 to discharge liquid into the sleeve. Sleeve 46 may be omitted and the wall of thickener 38 serve as an electrode. Conductor 50 will then be connected directly to the wall of thickener 38.

A sludge discharge line 54 extending from the lower end of conical section 40 is provided with a valve 56 for control or withdrawal of sludge from the thickener 38. A backflush liquid discharge line 58 is connected into thickener 38 near the lower end thereof but slightly above the lower end of sleeve 46. Backflush liquid discharge line 58 is connected for delivery of clarified backflush liquid into a hold tank 60. Removal of backflush liquid from the thickener 38 is controlled by a valve 62 in line 58.

A backflush line 64 extends from the lower end of hold tank 60 to a backflush pump 66. The outlet of backflush pump 66 is connected into a header 68 from which backflush inlet lines 70*a*, 70*b* and 70*c* open for delivery of backflush liquid into filters 14*a*, 14*b* and 14*c*, respectively. Each of the backflush inlet lines is provided with a valve indicated by reference numerals 72*a*, 72*b* and 72*c*.

In the operation of the apparatus shown in the drawing, a hydrocarbon liquid such as a feed stock for a hydrocracker and having finely divided solid particles, including iron oxide and iron sulfide particles, having a nominal diameter less than 5 microns and principally less than one micron suspended therein, is delivered through supply line 10 and inlet lines 12*a*, 12*b* and 12*c* into the upper end of each of the filters. The filters are electrically charged during the period that hydrocarbon liquids are delivered through the inlet lines to provide a voltage gradient between the electrode 18 and the wall of the casing in the range of 5 to 20 kv per inch. The hydrocarbon liquid flows downwardly through the permeable bed 26 of spherical particles and is discharged from the lower end of the filters through outlet lines 28*a*, 28*b* and 28*c* into the filtered product line 32. The hydrocarbon liquid flow rate can be such as to provide a superficial flow rate preferably in the range of 0.05 to 0.5 foot per second. Solid particles are deposited on the surfaces of the spherical particles comprising the filter bed 26.

When the filter bed becomes loaded with deposited solids, as indicated by an increase in the electrical current flowing from one electrode to the other, or after a predetermined time of filtering, the filter is decharged by disconnecting the electrode 18 from the power source. For example, if the excessive flow of current is through filter 14*a*, the electrode 18*a* is disconnected from the power source and valve 16*a* is closed to prevent flow of hydrocarbon liquid into the filter. Valve 35*a* is then opened to permit flow through line 34*a* into backflush liquid line 36 to the thickener 38. In a preferred manner of operation, filtered product delivered into line 32 from those electrofilters not being backflushed flows upwardly through line 28*a* into the lower end of bed 26*a*. If necessary, a valve 74 is installed in line 32 to insure a pressure high enough in line 32 to cause upward flow through the filter. The rate of backflushing is such that the filter bed 26 is expanded and the particles roll with respect to one another whereby the precipitated solids are removed. A superficial velocity of 0.05 to 0.6 foot per second is usually adequate. The concentration of solids in the backflush liquid discharged from the upper ends of the filters is in the range of one to ten percent by weight.

The backflush liquid having an entrained solids concentration of about 1 to 10 percent by weight is delivered through line 36 into electrothickener 38. A DC voltage is applied to electrode 42 to cause a voltage gradient of 10 to 30 kv per inch between electrode 42 and sleeve 46. The backflush liquid flows downwardly through the unobstructed space between the electrode 42 and sleeve 46 and as it does aggregation of the solid particles occurs to increase the size of the particles to a range whereby they settle rapidly from the liquid and accumulate in the conical section 40 of the thickener. A sludge comprising approximately 30 to 50 percent solids is withdrawn through discharge line 54.

In a normal operation, the filters 14 will operate for periods in the range of 4 to 8 hours before backflushing. The length of the run will depend largely on the feed stock to the filter and the nature of the solids in the feed stock. Longer runs may be obtained with feed stocks containing a low concentration of solid particles having a low electrical conductivity. Backflushing can be accomplished in a period of 1 to 5 minutes. Ordinarily, two minutes of backflushing is adequate to restore the filter to the condition it was in at the beginning of the immediately preceding filtration phase of the cycle. Thus, the amount of backflush liquid used is relatively small. It is contemplated that electrothickener 38 will be of a size to hold all of the backflush liquid used during the backflushing phase for any single filter. The backflush liquid can be delivered into thickener 38 and held in the thickener until a short time before the next filter is to be backflushed. The backflush liquid is then drained from the thickener through line 58 and suitably disposed of through line 76 which may, for example, be connected to deliver the liquid into filtered product line 32. After backflushing of filter 14*a* is completed, backflush outlet valve 35*a* is closed, the electrode 18*a* is connected to the power source, and valve 16*a* is opened to allow flow downwardly through the filter bed 26.

If it is desired to use the same liquid repeatedly for backflushing, backflush liquid can be drained from the thickener 38 into hold tank 60. Then when it is desired to backflush a filter, such as filter 14*a*, the electrode 18*a* is decharged, valves 16*a* and 30*a* are closed, valves 72*a* and 35*a* are opened and pump 66 is started to circulate the backflush liquid upwardly through the bed 26. The backflush liquid remaining in the filter 14 at the end of the backflushing can be drained back into the hold tank 60 before the filter 14 is put back in operation. Even though the backflush liquid is drained from the filter at the end of the backflushing operation, the backflush liquid should be nonconductive to avoid short circuiting when filtration is resumed and, preferably, similar to the filtered product to minimize contamination of the filtered product.

The solid particles in the hydrocarbon liquid delivered through supply line 10 are so small that they cannot be separated from the hydrocarbon liquid by sedimentation. Moreover, the electrothickener 38 is not effective in speeding sedimentation of those particles from the hydrocarbon liquid feed stock. Aggregation of the solid particles occurs in the electrofilters 14. Whereas an 0.8 micron filter is required to separate the solids from the original hydrocarbon liquid feed stock, an 8 micron filter is effective in removing solids from the backflush liquid discharged from the filters. While the solid particles discharged from the upper end of the filters during the backflushing can be settled from the backflush liquid, the rate of settling is so slow that large, expensive settling tanks are required. Settling periods of the order of 24 hours or more are required for settling the entrained solids from the backflush liquid. After treatment in the electrothickener 38, settling can be accomplished in a period of 5 minutes or less.

We claim:

1. A method of separating finely divided solid particles having a nominal diameter less than 5 microns from a nonconductive liquid comprising maintaining a voltage gradient of 5–20 kilovolts per inch in a permeable bed of smooth ceramic spheres having a diameter of one-eighth inch to one-fourth inch supported within a filter casing, passing the nonconductive liquid through the permeable bed whereby solid particles in the liquid are deposited on the ceramic spheres, discharging filtered product from the filter, decharging the filter by discontinuing the voltage gradient through the filter bed when the amount of solids deposited increases above a desired range, flowing a backflush liquid upwardly through the decharged permeable bed at a rate adapted to remove deposited solids from the spheres, discharging from the filter backflush liquid with entrained solids removed from the spheres, delivering the backflush liquid and entrained solids into an electrothickener containing spaced-apart electrodes with unobstructed space between the electrodes, applying a voltage gradient of 10–30 kilovolts per inch to the backflush liquid in the electrothickener, holding the backflush liquid in the electrothickener to allow settling of solid particles from the backflush liquid in the electrothickener, withdrawing settled solids from the bottom of the electrothickener, and separately withdrawing backflush liquid from the electrothickener.

2. The method as set forth in claim 1 in which the backflush liquid is the filtered product.

3. The method as set forth in claim 1 in which the nonconductive liquid is a hydrocarbon liquid feed stock for a fixed bed catalytic process.

4. The method as set forth in claim 3 in which the backflush liquid is the filtered product.

5. The method as set forth in claim 4 in which the hydrocarbon liquid is passed downwardly through the permeable bed at a superficial velocity of 0.05 to 0.5 foot per second during the filtering operation and upwardly through the permeable bed at a superficial velocity of 0.05 to 0.6 foot per second during backflushing.

6. The method as set forth in claim 3 in which the backflush liquid discharged from the electrofilter contains 1 to 10 percent suspended solids and a sludge containing 30 to 50 percent solids is withdrawn from the electrothickener.

7. The method as set forth in claim 1 in which a plurality of electrofilters are operated in parallel and discharge filtered product into a common filtered product line, and backflushing is accomplished in an electrofilter by delivering filtered product from the common filtered product line upwardly through the filter being backwashed while the others continue the filtering operation.

8. A method as set forth in claim 1 in which a plurality of electrofilters are operated in parallel, the electrofilters are backflushed successively, and the settled solids and the backflush liquid from the backflushing of one electrofilter are withdrawn from the electrothickener just before the next electrofilter is backflushed.

9. A method as set forth in claim 8 in which the voltage gradient is maintained between the electrodes in the electrothickener for a period up to about 5 minutes.

10. A method as set forth in claim 8 in which each of the filters operates for at least about 4 hours between backflushing, the backflushing of each electrofilter is continued for up to about 5 minutes, and the voltage gradient is maintained in the electrothickener for approximately 5 minutes after delivery of solids-laden backflush liquid into the electrothickener.

11. A method as set forth in claim 8 in which the backflush liquid withdrawn from the electrothickener is delivered to a storage tank, backflush liquid is pumped from the storage tank through the electrofilters during the backflushing, and backflush liquid in an electrofilter at the end of the backflushing of an electrofilter is drained back into the storage tank.

* * * * *